US006425222B1

(12) United States Patent
Hagel

(10) Patent No.: US 6,425,222 B1
(45) Date of Patent: Jul. 30, 2002

(54) METHOD AND KIT FOR REPAIRING A CONSTRUCTION COMPONENT

(75) Inventor: Richard C. Hagel, Nacogdoches, TX (US)

(73) Assignee: Burns Norris & Stewart Limited Partnership, Nacogdoches, TX (US)

( * ) Notice: Subject to any disclaimer, the term of this patent is extended or adjusted under 35 U.S.C. 154(b) by 25 days.

(21) Appl. No.: 09/255,079

(22) Filed: Feb. 19, 1999

Related U.S. Application Data

(63) Continuation-in-part of application No. 09/130,160, filed on Aug. 6, 1998, now Pat. No. 5,950,391, which is a continuation of application No. 08/837,776, filed on Apr. 22, 1997, now Pat. No. 5,873,209, which is a continuation of application No. 08/612,757, filed on Mar. 8, 1996, now Pat. No. 5,661,943.

(51) Int. Cl.[7] ..... E04G 23/02

(52) U.S. Cl. ..... 52/741.3; 52/745.21; 156/71; 156/98; 264/36; 405/211; 405/216; 405/232

(58) Field of Search ..... 29/402.08, 402.12, 29/402.14; 52/170, 101, 514, 515, 517, 741.3, DIG. 8, DIG. 12, DIG. 4, 514.5, 745.21, 741.4; 405/211, 216, 232; 264/152, 36

(56) References Cited

U.S. PATENT DOCUMENTS

| | | | | | |
|---|---|---|---|---|---|
| 2,281,864 | A | | 5/1942 | Toothacre | |
| 2,292,301 | A | | 8/1942 | Smith | |
| 2,292,806 | A | | 8/1942 | Toothacre | |
| 2,781,559 | A | | 2/1957 | Savoie | |
| 2,854,843 | A | | 10/1958 | Lamb | |
| 2,898,642 | A | | 8/1959 | Etling | |
| 3,690,082 | A | | 9/1972 | Byland | |
| 3,769,773 | A | | 11/1973 | Mochizuki | |
| 3,808,759 | A | | 5/1974 | Carmichael | |
| 3,812,621 | A | | 5/1974 | Ragland | |
| 3,911,548 | A | * | 10/1975 | Perry | 29/401 |
| 4,306,821 | A | * | 12/1981 | Moore | 405/216 |
| 4,492,496 | A | * | 1/1985 | Arnold | 405/303 |
| 4,516,365 | A | * | 5/1985 | Chapman | 52/170 |
| 4,543,764 | A | * | 10/1985 | Kozikowski | 52/514 |
| 4,644,722 | A | * | 2/1987 | Phillips | 52/514 |
| 4,702,057 | A | * | 10/1987 | Phillips | 52/514 |
| 4,779,389 | A | * | 10/1988 | Landers | 52/742 |
| 4,866,901 | A | * | 9/1989 | Sanchez | 52/514 |
| 4,892,601 | A | * | 1/1990 | Norwood | 156/94 |
| 5,022,134 | A | * | 6/1991 | George | 29/402.08 |
| 5,074,092 | A | | 12/1991 | Norlander | |
| 5,175,973 | A | * | 1/1993 | Owen et al. | 52/742 |
| 5,337,469 | A | * | 8/1994 | Richey | 29/402.12 |
| 5,365,708 | A | | 11/1994 | Winston | |
| 5,380,131 | A | * | 1/1995 | Crawford | 405/216 |
| 5,437,130 | A | | 8/1995 | Raynak | |
| 5,516,236 | A | * | 5/1996 | Williams et al. | 405/216 |
| 5,524,408 | A | * | 6/1996 | Richey | 52/514.5 |
| 5,546,715 | A | | 8/1996 | Edstrom | |
| RE35,322 | E | * | 9/1996 | Owen et al. | 52/741.14 |
| 5,553,438 | A | | 9/1996 | Hsu | |
| 5,573,354 | A | * | 11/1996 | Koch | 405/211 |
| 5,813,800 | A | * | 9/1998 | Doleshal | 405/232 |
| 5,829,920 | A | * | 11/1998 | Christenson | 405/216 |
| 6,098,351 | A | * | 8/2000 | Mills | 52/169.4 |

* cited by examiner

*Primary Examiner*—Carl D. Friedman
*Assistant Examiner*—Yvonne M. Horton
(74) *Attorney, Agent, or Firm*—Standley & Gilcrest LLP

(57) ABSTRACT

The present invention is a method and kit for repairing a construction component that has a damaged portion. First, the damaged portion is removed from the construction component. Next, a durable portion is provided that is preferably a cellulosic/polymer composite material which is moisture, decay, and insect resistant. The durable portion preferably has about the same shape as the damaged portion. The durable portion is then connected to the construction component to replace the damaged portion. The materials for repairing the construction component may be provided in a single kit.

18 Claims, 5 Drawing Sheets

METHOD AND KIT FOR REPAIRING A CONSTRUCTION COMPONENT

This is a continuation-in-part of U.S. application Ser. No. 09/130,160, filed Aug. 6, 1998, now U.S. Pat. No. 5,950,391. U.S. application Ser. No. 09/130,160 is a continuation of U.S. application Ser. No. 08/837,776, filed Apr. 22, 1997, now U.S. Pat. No. 5,873,209. U.S. application Ser. No. 08/837,776 is a continuation of U.S. application Ser. No. 08/612,757, filed Mar. 8, 1996, now U.S. Pat. No. 5,661,943.

BACKGROUND AND SUMMARY OF THE INVENTION

The present invention relates generally to a method and kit for repairing a construction component, and more particularly, to a method and kit for repairing a construction component that has a deteriorating or damaged portion. The present invention is particularly useful for repairing wooden construction components that have been harmed by moisture, decay, or insects. However, those skilled in the art should recognize that the present invention may be utilized to repair practically any type of damage that may be caused to a construction component.

A portion of a construction component may be damaged while the remainder of the construction component remains substantially undamaged. For one example, repeated mopping of a floor may cause deterioration of the bottom portions of wooden doors and door frames which come into contact with the mop. For another example, a portion of a deck plank may be damaged by termites.

In light of this problem, a need exists for a method for replacing only a damaged portion of a construction component. Another need exists for a method for repairing a construction component to prevent the same type of damage in the future. Yet another need exists for a method for repairing a construction component which results in a desired physical appearance.

The present invention satisfies some or all of these needs. One embodiment of the present invention provides a method for repairing a wooden component. First, a desired portion is removed from the wooden component. The desired portion may be damaged, deteriorating, discolored, or in practically any state of disrepair. Next, a durable portion is provided that is preferably comprised of a cellulosic/polymer composite material which is moisture, decay, and insect resistant. The durable portion preferably has about the same shape as the desired portion. The durable portion is then connected to the wooden component to replace the desired portion.

Another embodiment of the present invention provides a method for repairing a construction component that is comprised of fibrous material. In this method, a desired portion is removed from the construction component. The desired portion may be damaged, deteriorating, discolored, or in practically any state of disrepair. A durable portion is then provided which preferably has about the same shape as the desired portion that was removed from the construction component. The durable portion may be comprised of a cellulosic/polymer composite material which is moisture, decay, and insect resistant. The durable portion is then connected to the construction component to replace the desired portion.

The methods of the present invention may be used to repair practically any type of construction component that is comprised of fibrous material. For example, the methods of the present invention may be used to repair doors, door frames, window frames, deck planks, garage doors, garage door frames, porch posts, fence posts, casings, brickmolds, and other similar types of components. It should also be recognized that the methods of the present invention may be used to repair other types of components, whether or not comprised of a fibrous material, that have a damaged portion that may be removed.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a method and kit for repairing a construction component that has a portion which is deteriorating, damaged, discolored, or in a state of disrepair. The present invention is particularly useful for repairing damage to a construction component that is caused by moisture, decay, or insects. However, it is believed that the patentability of the present invention is not dependent on the cause or type of damage.

Figure 1:
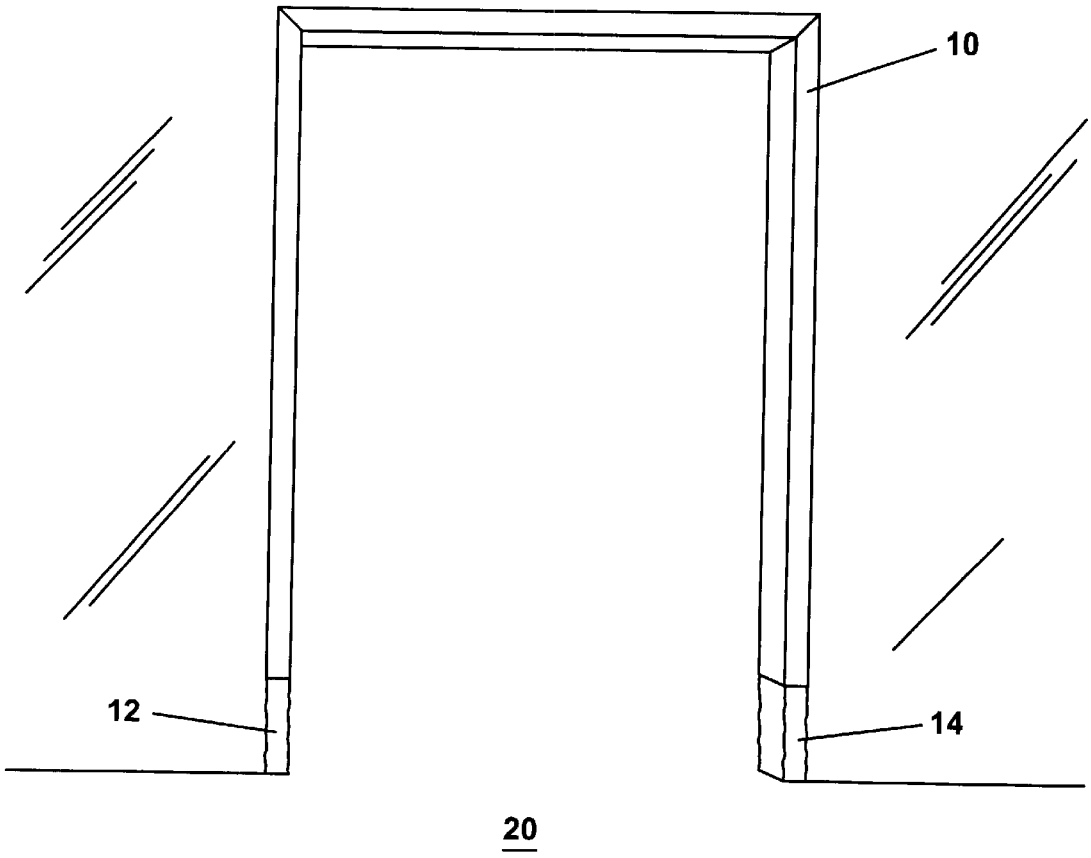
FIG. 1 is a perspective view of a door frame that has been damaged by repeated mopping of the surrounding floor.

FIG. 1 shows an example of a door frame 10 that has been damaged by repeated mopping of a floor 20. In particular, portions 12, 14 of the door frame 10 have deteriorated due to excessive contact with a wet mop. In order to repair the door frame 10 according to a preferred method of the present invention, the portions 12, 14 are removed from the door frame 10. The portions 12, 14 may be removed from the door frame 10 by any conventional means including, but not limited to, cutting, sawing, chopping, sanding, and other suitable wood, plastic, and metal processing techniques.

Figure 2:
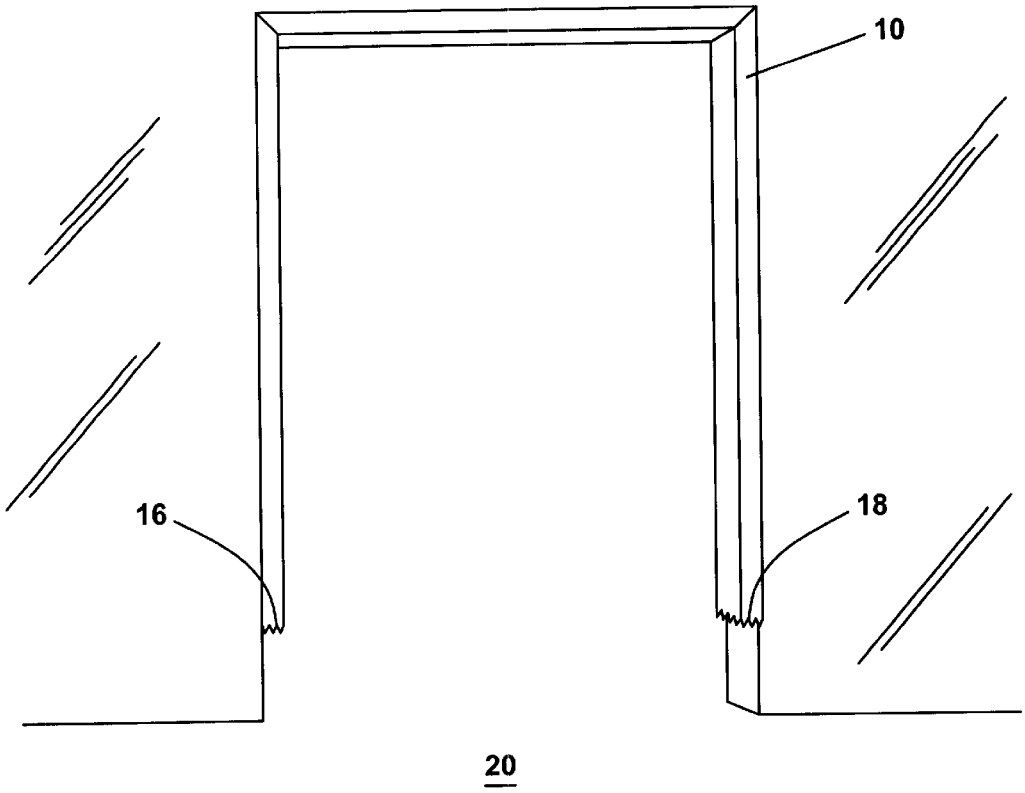
FIG. 2 is a perspective view of the door frame of FIG. 1 after the damaged portions have been removed according to a preferred method of the present invention.

FIG. 2 shows the door frame 10 after the portions 12, 14 have been removed. Before, during, or after the removal of portions 12, 14, the edges 16, 18 of the door frame 10 may be shaped, finished, and contoured to facilitate the formation of joints between the door frame 10 and the durable portions that replace the portions 12, 14. The edges 16, 18 may be shaped, finished, and contoured by any conventional means including, but not limited to, cutting, sawing, chopping, sanding, and other suitable wood, plastic, and metal processing techniques.

Figure 3:
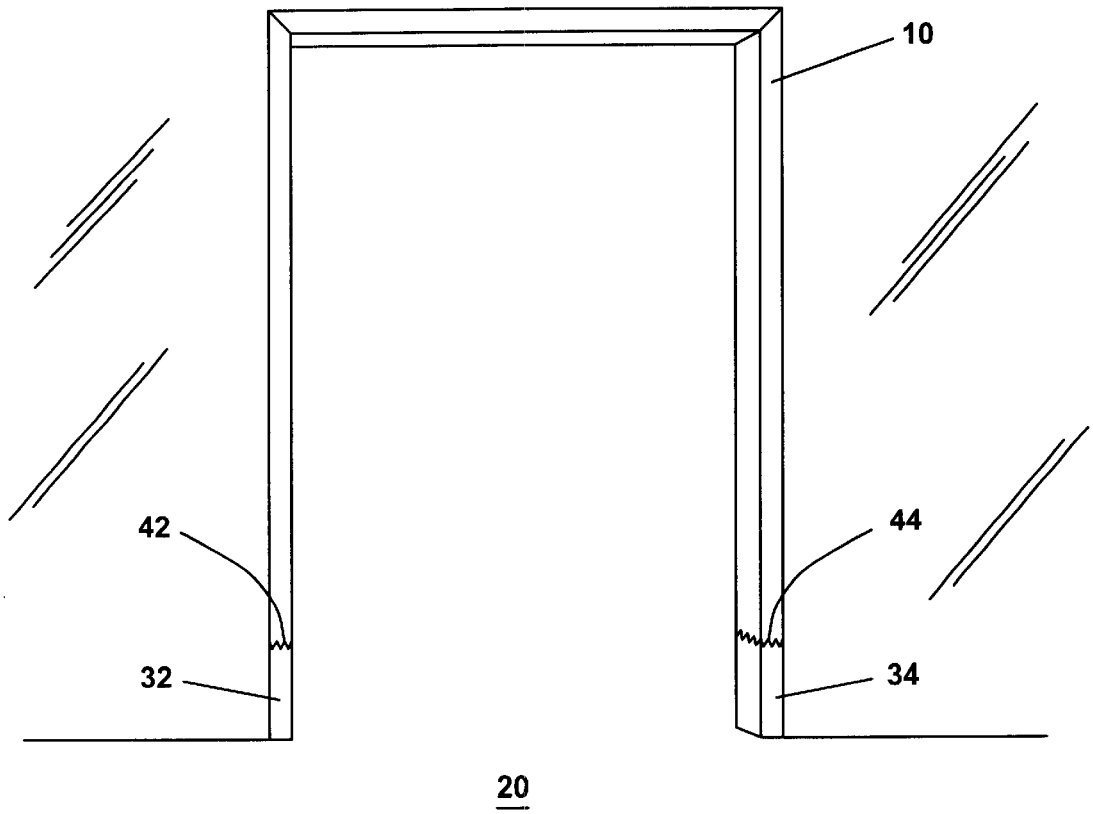
FIG. 3 is a perspective view of the door frame of FIG. 1 after the damaged portions have been replaced with durable portions according to a preferred method of the present invention.

FIG. 3 shows the door frame 10 after the durable portions 32, 34 have been connected to the door frame 10 according to a preferred method of the present invention to replace the portions that were removed from the door frame 10. The durable portions 32, 34 are preferably moisture, decay, and insect resistant, and the durable portions 32, 34 are preferably resistant to the type of damage sustained by portions 12, 14. The durable portions 32, 34 may be comprised of practically any material that may be shaped or formed into a desired shape. For example, the durable portions 32, 34 may be comprised of wood, treated wood, plastic, vinyl, metal, or combinations that include any of these materials such as material composites including, but not limited to, polyvinyl chloride (PVC) formulations, high density polyethylene (HDPE) formulations, cellulosic/polymer composites, and other similar material composites. As known in the art, cellulosic/polymer composites may be sawed, sanded, shaped, turned, fastened, finished, painted, and stained in the same or similar manner as natural woods. Examples of extrudable cellulosic/polymer composites that may be utilized in preferred embodiments of the present invention include TIMBERTECH®, ERT®, TREX®, and the like.

A cellulosic/polymer composite material may be comprised of one or more raw materials including, but not limited to, cellulosic materials, thermoplastic materials, inorganic fillers, cross-linking agents, process lubricants, accelerators, inhibitors, enhancers, compatibilizers, blowing agents, and other suitable materials. Examples of cellulosic materials include sawdust, newspapers, alfalfa, wheat pulp, wood chips, wood fibers, wood particles, ground wood, wood flour, wood flakes, wood veneers, wood laminates, paper, cardboard, straw, cotton, rice hulls, coconut shells, peanut shells, bagass, plant fibers, bamboo fiber, palm fiber, kenaf, and other fibrous materials. The thermoplastic materials may include multilayer films, HDPE, polypropylene, PVC, low density polyethylene (LDPE), CPVC ABS, ethylvinyl acetate, other suitable polyethylene copolymers, other suitable thermoplastic materials, and formulations that incorporate any of the aforementioned materials. Examples of inorganic fillers include talc, calcium carbonate, kaolin clay, magnesium oxide, titanium dioxide, silica, mica, barium sulfate, and other suitable inorganic materials. Cross-linking agents may include polyurethanes such as isocyanates, phenolic resins, unsaturated polyesters, and epoxy resins. Combinations of the aforementioned agents are also known examples of cross-linking agents. In addition, lubricants such as zinc stearate and wax may be used to aid the shaping process.

Each of the durable portions 32, 34 may have practically any shape which enables it to be connected to the door frame 10 to replace the respective portion that was removed from the door frame 10. It is preferred that the durable portions 32, 34 have shapes that are about the same as the respective shapes of the portions that each will replace to repair the door frame 10. Herein, when it is stated that a durable portion has approximately the same shape as the portion which it will replace, it is referring to the shape of the portion prior to any damage which may have been sustained by the portion.

The durable portions 32, 34 may be shaped or formed using conventional techniques. For example, if the durable portions 32, 34 are comprised of thermoplastic or cellulosic/polymer composite materials, the durable portions 32, 34 may be extruded or molded to obtain final net shapes. In addition, other conventional wood, plastic, and metal processing techniques including, but not limited to, cutting, sawing, chopping, and sanding may be utilized to achieve the final net shapes of the durable portions 32, 34.

The durable portions 32, 34 may be connected to the door frame 10 utilizing conventional techniques, and the joints between the durable portions 32, 34 and the door frame 10 may be of any suitable type. For maximum aesthetic appeal, it is preferred that edges of the durable portions 32, 34 are adapted to mate with the respective edges 16, 18 of the door frame 10. FIG. 3 shows examples of glued finger joints 42, 44 between edges of the durable portions 32, 34 and the respective edges 16, 18 of the door frame 10. Another example of a joint may be formed by adhesively bonding a substantially flat edge of a durable portion to a substantially flat edge of a component that is being repaired. In addition to adhesives such as glues, epoxies, and other suitable adhesives, a durable portion may be connected to a construction component by at least one dowel, by mechanical means such as a brace, a bracket, a hinge, pins, nails, screws, clamps, or other mechanical fastening devices, or by fastening the durable portion and the construction component to a common support structure (e.g., a wall) using adhesives, dowels, or any of the aforementioned mechanical means.

Figure 4:
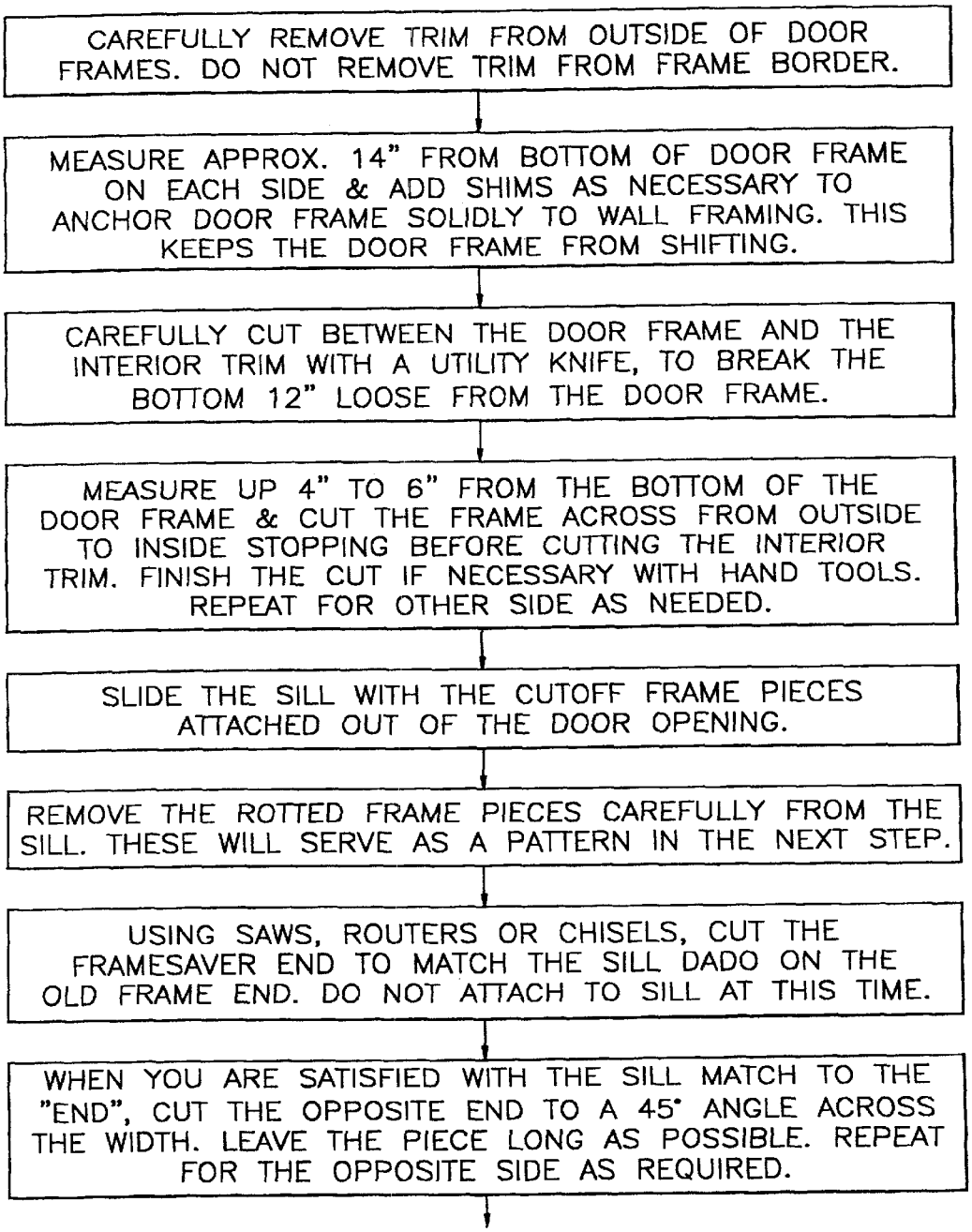
FIG. 4 is a flow diagram of a preferred method of the present invention for repairing a construction component.
Figure 4:
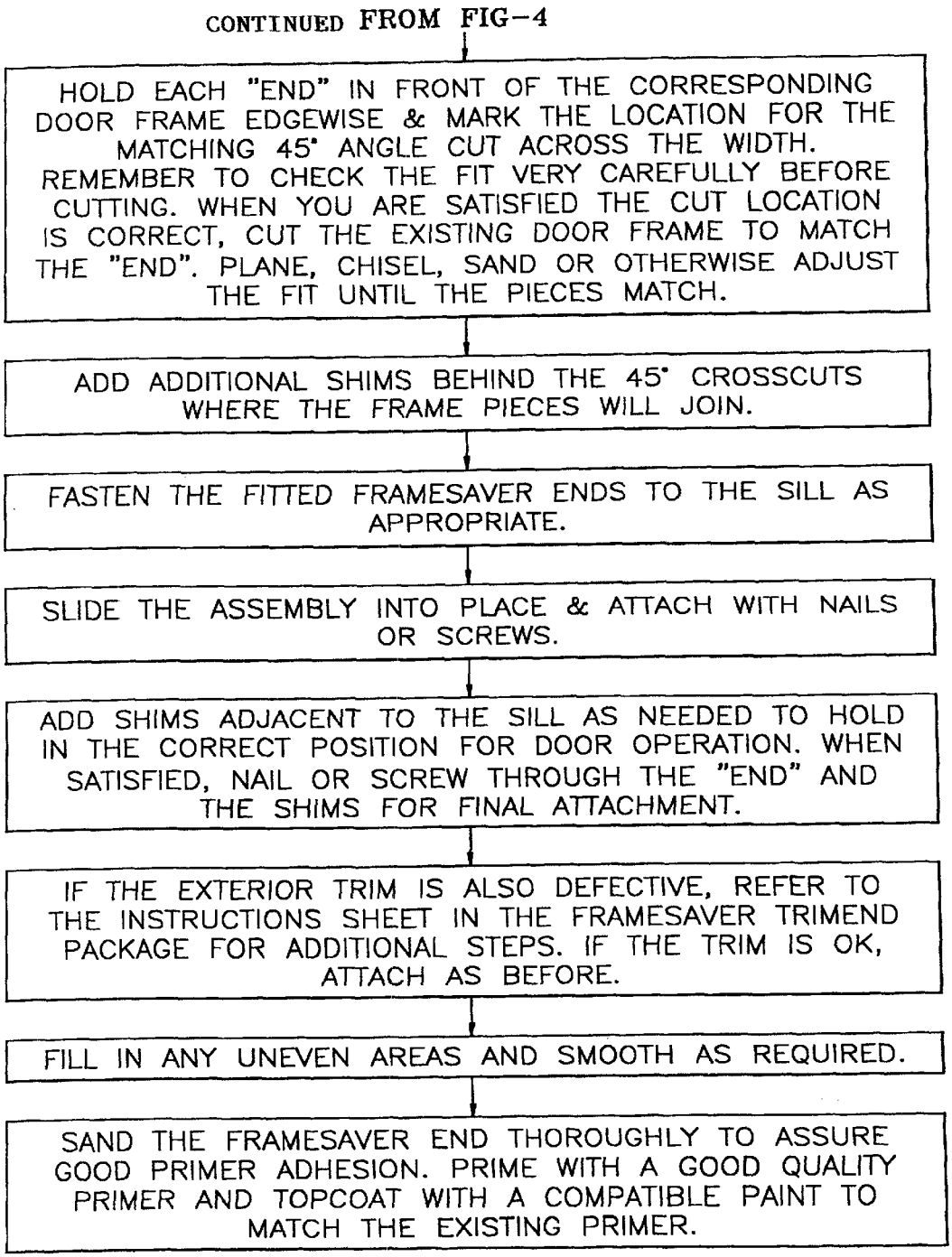

The materials for repairing the construction component may be provided in a single kit. The kit may include one or more durable portions, sandpaper, shims, adhesives, mechanical fastening means, tools for removing the damaged portion(s) and/or installing the durable portion(s) (e.g., a saw, a utility knife, a hand-operated cutting tool, a router, a plane, and/or a chisel), a form or pattern that enables a user to mark the construction component so that a desired portion of the construction component may be removed, written or pictorial instructions for repairing the construction component using the kit, and any other suitable materials that may facilitate the repair of the construction component. One example of a form or pattern is a molded piece that generally conforms to the shape of the construction component so that the construction component may be easily marked or cut. FIG. 4 is a flow diagram of a preferred set of instructions for repairing a door frame that has a damaged portion. As used therein, FrameSaver™ End refers to a durable portion of the present invention that may be used to repair a door frame, and FrameSaver™ TrimEnd refers to a durable portion of the present invention that may be used to repair the trim of a door frame.

The items in each kit are preferably adapted to repair a particular shape and type of construction component such as a particular door or window frame. For example, the durable portion may have a predetermined shape, length (e.g., 8 or 10 inches), and edge. In addition, the form or pattern may have a predetermined shape, length, and edge so that the shape of the portion to be removed from the construction component is approximately the same as the shape of the durable portion.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for repairing a wooden component, said method comprising:

removing a desired portion of said wooden component;

providing a durable portion to replace said desired portion, said durable portion comprised of a cellulosic/polymer composite material, and of approximately the same size and shape as said desired portion; and connecting said durable portion to said wooden component to replace said desired portion;

wherein after connection of said durable portion, said wooden component has substantially the same appearance.

2. The method of claim 1 wherein said desired portion of said wooden component is deteriorating.

3. The method of claim 1 wherein said desired portion of said wooden component is damaged.

4. The method of claim 1 wherein said durable portion is connected to said wooden component by a finger joint.

5. The method of claim 1 wherein said durable portion is connected to said wooden component by at least one dowel.

6. The method of claim 1 wherein said durable portion is connected to said wooden component by an adhesive.

7. The method of claim 1 wherein said durable portion is connected to said wooden component by mechanical means.

8. The method of claim 1 wherein said durable portion is provided by extrusion.

9. The method of claim 1 wherein said durable portion is provided by molding.

10. The method of claim 1 wherein said wooden component is a member of the group consisting of a door, a door frame, a window frame, a deck plank, a garage door, a garage door frame, a porch post, a casing, and a brickmold.

11. A method for repairing a construction component that is comprised of fibrous material, said method comprising:

removing a desired portion of said construction component;

providing a durable portion to replace said desired portion, said durable portion comprised of a cellulosicipolymer composite material which is moisture, decay, and insect resistant, and having approximately the same size and shape as said desired portion; and connecting said durable portion to said construction component to replace said desired portion;

wherein after connection of said durable portion, said wooden component has substantially the same appearance.

12. The method of claim 11 wherein said desired portion of said construction component is harmed by moisture, decay, or insects.

13. A kit comprising the combination of:

a durable member of formed from a cellulosic/polymer composite material, said durable member of approximately the same size and shape of a section of a preexisting structure that must be removed;

means for connecting said durable member to a portion of said preexisting structure once said section has been removed;

means for allowing a user of said kit to further conform said durable member to the size and shape of said section of said preexisting structure that was removed; and means for instructing a user of said kit how to install said durable member;

whereby said kit permits a user thereof to replace said removed section of said preexisting structure with said durable portion in such a manner that said preexisting structure has substantially the same appearance after connection of said durable portion.

14. The kit of claim 13 further comprising at least one shim.

15. The kit of claim 13 further comprising sandpaper.

16. The kit of claim 13 further comprising tool means for removing a decayed or damaged portion from said preexisting structure.

17. The kit of claim 13 further comprising tool means for installing said durable member.

18. The kit of claim 13 further comprising means for marking said preexisting structure such that a desired portion of said preexisting structure is removed and replaced by said durable member.

* * * * *